US005518474A

United States Patent [19]

Barksdale

[11] Patent Number: 5,518,474

[45] Date of Patent: May 21, 1996

[54] EXERCISE MACHINE

[76] Inventor: Erline J. Barksdale, 8115 Providence Forest Ct., Richmond, Va. 23235

[21] Appl. No.: 496,920

[22] Filed: Jun. 30, 1995

[51] Int. Cl.[6] ..... A63B 21/00

[52] U.S. Cl. ..... 482/57; 482/112; 482/908

[58] Field of Search ..... 482/57, 58, 59, 482/60, 62, 63, 79, 80, 111, 112, 908

[56] References Cited

U.S. PATENT DOCUMENTS

| | | | |
|---|---|---|---|
| 3,887,180 | 6/1975 | Berman | 272/58 |
| 4,587,960 | 5/1986 | Schotten | 482/62 |
| 4,772,016 | 9/1988 | Manion | 482/112 |
| 5,090,694 | 2/1992 | Pauls et al. | 272/134 |
| 5,145,475 | 9/1992 | Cares | 482/62 |
| 5,158,515 | 10/1992 | Cortes Tucios | 482/57 |
| 5,234,394 | 8/1993 | Wilkinson | 482/92 |
| 5,338,272 | 8/1994 | Sweeney | 482/57 |

*Primary Examiner*—Stephen R. Crow
*Attorney, Agent, or Firm*—John D. Gugliotta

[57] ABSTRACT

An improved exercise device is disclosed that allows the user to exercise while watching television. A horizontal, metal base extends past the unit for the purpose of securing the device under a couch or chair during use. The main body of the device consists primarily of two triangular boxes vertically attached by a support. On the face of each box are two moveable pedals or levers. Inside the triangular boxes and attached to the pedals or levers are air pressure compartments used to build up resistance when the pedals are pushed, pulled, or pumped. The device can also be separated into two units for the user to do additional floor exercises, isolating such areas as the waist and stomach.

12 Claims, 4 Drawing Sheets

EXERCISE MACHINE

BACKGROUND OF THE INVENTION

1. Field of the Invention

The present invention relates generally to exercise equipment and devices and, more particularly, to portable exercise equipment and devices adapted to be utilized while sitting.

2. Description of the Related Art

As is well known in the art, there are many types and routines of exercise, depending upon which muscles or other body attribute is to be exercised. As a result, there are many types and constructions of exercise equipment. As exists in the related art, numerous forms of exercise devices have been disclosed that can be adapted for use while in the sitting position.

For instance, U.S. Pat. No. 5,234,394 issued in the name of Wilkinson, discloses a universal, portable exercise apparatus adaptable to fit a chair. However, an exercise machine made in accordance with this reference is associated with several limitations. For example, the Wilkinson reference is strictly limited to use with a chair, and especially with a conventional chair having a sturdy backrest to support the device. Moreover, although not limited to exercise of the upper body, the invention disclosed in the Wilkinson reference is, in fact, most easily adapted to exercise the upper body.

In U.S. Pat. No. 5,158,515 issued in the name of Cortes Tucios, an entertaining exercise apparatus is disclosed. The Cortes Tucios reference provides a exercise machine which emulates an exercise bike. The user sits upon the device and pedals. However, rather than a stationary bike being utilized in which the pedal energy is transferred to a rotational wheel not in contact with the ground, the Cortes Tucios reference discloses a three-legged stool type bike whose three wheels rotate in a circular pattern beneath the user. An exercise machine made in accordance with the Cortes Tucios reference appears to be limited in its effectiveness to those same benefits associated with a conventional stationary bicycle.

Also, in U.S. Pat. No. 5,090,694, issued in the name of Pauls et al. a combination chair and exercise unit is disclosed. An exercise device made in accordance with the Pauls et al. reference provides for a plurality of various exercise positions in a foldable chair-type structure. However, as disclosed in the Pauls et al. reference, such an exercise device is incorporated along with an integral chair structure, and is not intended to be used in conjunction with conventional furniture such as a couch, loveseat, or chair. The Pauls et al. reference mainly disguises an exercise device as a conventional chair.

Finally, in U.S. Pat. No. 3,887,180 issued in the name of Berman, an exercise apparatus for bedridden patients is disclosed. The Berman reference discloses an exercise apparatus which provides spring resistance for a variety of leg strengthening exercise, and which attaches to a bed end frame, thereby providing a means of exercise for those bedridden and for those who would otherwise be unable to exercise their legs. However, a device such as the one taught from the Berman reference is limited by the necessity of requiring first a bed, and second a sturdy lower end frame for attachment of such a device.

Consequently, a need has therefore been felt for an improved but less complex mechanism that can be used for aiding in exercise of both the lower and upper body while being utilized in a sitting position on a chair, couch, or other conventional piece of furniture.

SUMMARY OF THE INVENTION

It is therefore an object of the present invention to provide an improved exercise device.

It is another object of the present invention to provide an improved exercise device that may be used from a sitting position.

It is another object of the present invention to provide an improved exercise device that may be used from a sitting position and which allows the user to exercise while engaged in some other entertaining activity, such as watching television or reading a book.

It is another object of the present invention to provide an improved exercise device that utilizes pneumatic resistance to counter exercise movement, thereby multiplying and accelerating the exercise effect.

It is yet another object of the present invention to provide an improved exercise device that can be assembled and disassembled in a number of variations to prevent the user from becoming bored with the device after a short period of time.

Briefly described according to the preferred embodiment of the present invention, an improved exercise device is disclosed that allows the user to exercise while watching television. A horizontal, metal base extends past the unit for the purpose of securing the device under a couch or chair during use. The main body of the device consists primarily of two triangular boxes vertically attached by a support. On the face of each box are two moveable pedals or levers. Inside the triangular boxes and attached to the pedals or levers are air pressure compartments used to build up resistance when the pedals are pushed, pulled, or pumped. The device can also be separated into two units for the user to do additional floor exercises, isolating such areas as the waist and stomach.

An advantage of the present invention is that the exercise device can be used while sitting on a couch watching television.

Another advantage of the present invention is that it can be separated into two units for the user to do additional floor exercises.

Another advantage of the present invention is that it can be easily disassembled for storage in a closet, under a couch, or in any other compact area.

Another advantage of the present invention is that it utilizes air pressure chambers to build resistance to movement to increase the exercise effect.

Further, a preferred embodiment of the present invention helps the user overcome the single largest barrier to exercise: motivation. The present invention can lead the user into a regiment of exercise without ever having to get off the couch.

BRIEF DESCRIPTION OF THE DRAWINGS

The advantages and features of the present invention will become better understood with reference to the following more detailed description and claims taken in conjunction with the accompanying drawings, in which like elements are identified with like symbols, and in which:

DESCRIPTION OF THE PREFERRED EMBODIMENTS

1. Detailed Description of the Figures

Figure 1:
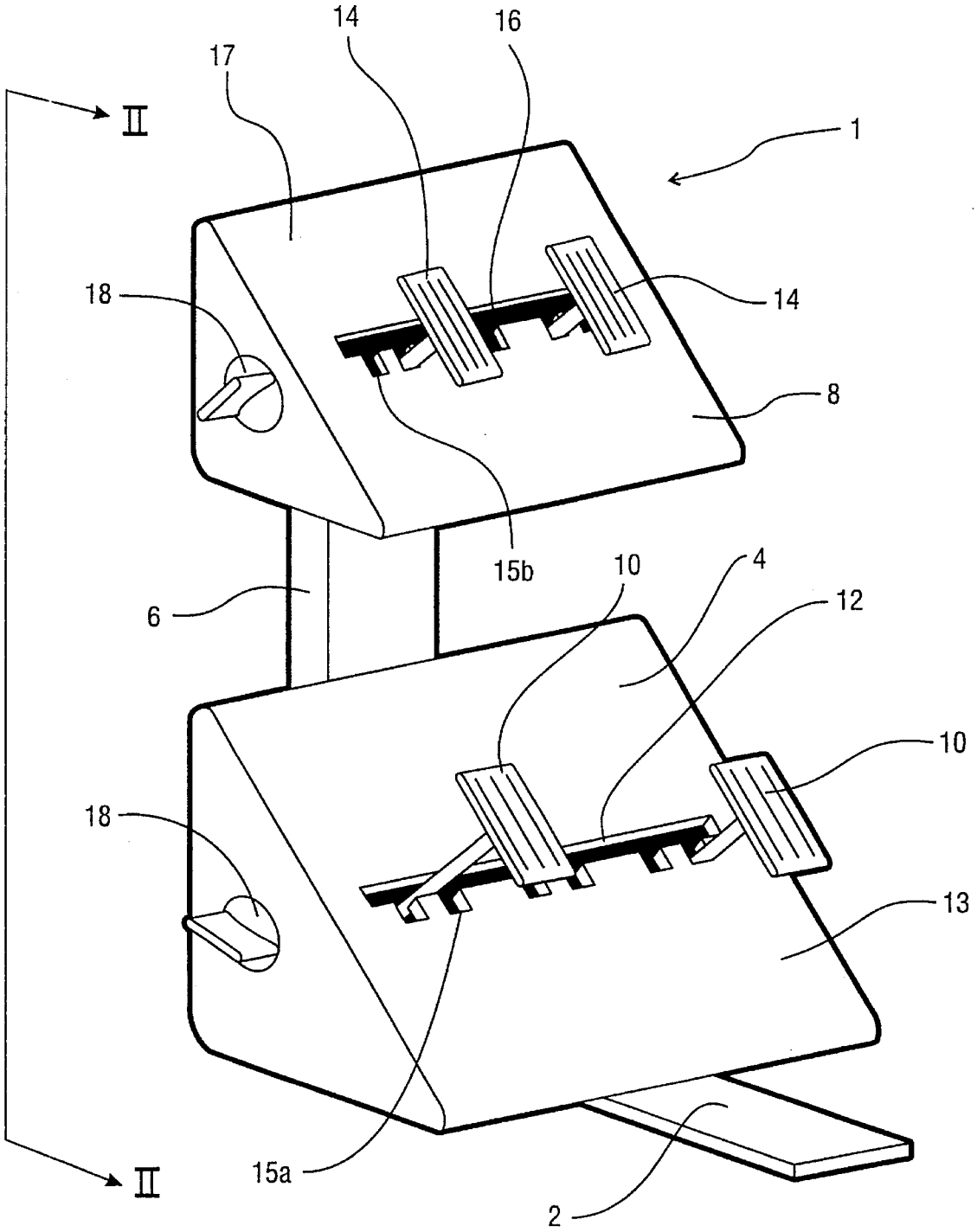
FIG. 1 is an orthographic view of an exercise device according to the preferred embodiment of the present invention.

Referring now to FIG. 1, an exercise device 1 is shown, according to the present invention, consisting of a base 2 attached to a lower housing 4. The base 2 is laterally elongated such as to provide a stabilizing platform when placed under a couch or chair. A connecting post 6 detachably connects the lower housing 4 to an upper housing 8. A pair of foot pedals 10 protrude through the lower housing 4 through a foot pedal adjustment slot 12 penetrating the first face 13 of the lower housing 4. The foot pedal adjustment slot 12 incorporates a plurality of first spacing adjustment notches 15A to allow the user to adjust the separation between the foot pedals 10 to increase user comfort, fitness level, or intensity of workout, with a wider separation between the foot pedals 10 generally requiring greater effort in order to depress the foot pedals 10. A pair of hand pedals 14 protrude through the upper housing 8 through a hand pedal adjustment slot 16 penetrating the second face 17 of the upper housing 8. The hand pedal adjustment slot 16 incorporates a plurality of second spacing adjustment notches 15B to allow the user to adjust the separation between the hand pedals 14 to increase user comfort, fitness level, or intensity of workout, with a wider separation between hand pedals 14 generally requiring greater effort in order to depress the hand pedals 14. Aside each the lower housing 4 and upper housing 8 are located a tension adjustment dial 18.

Figure 2:
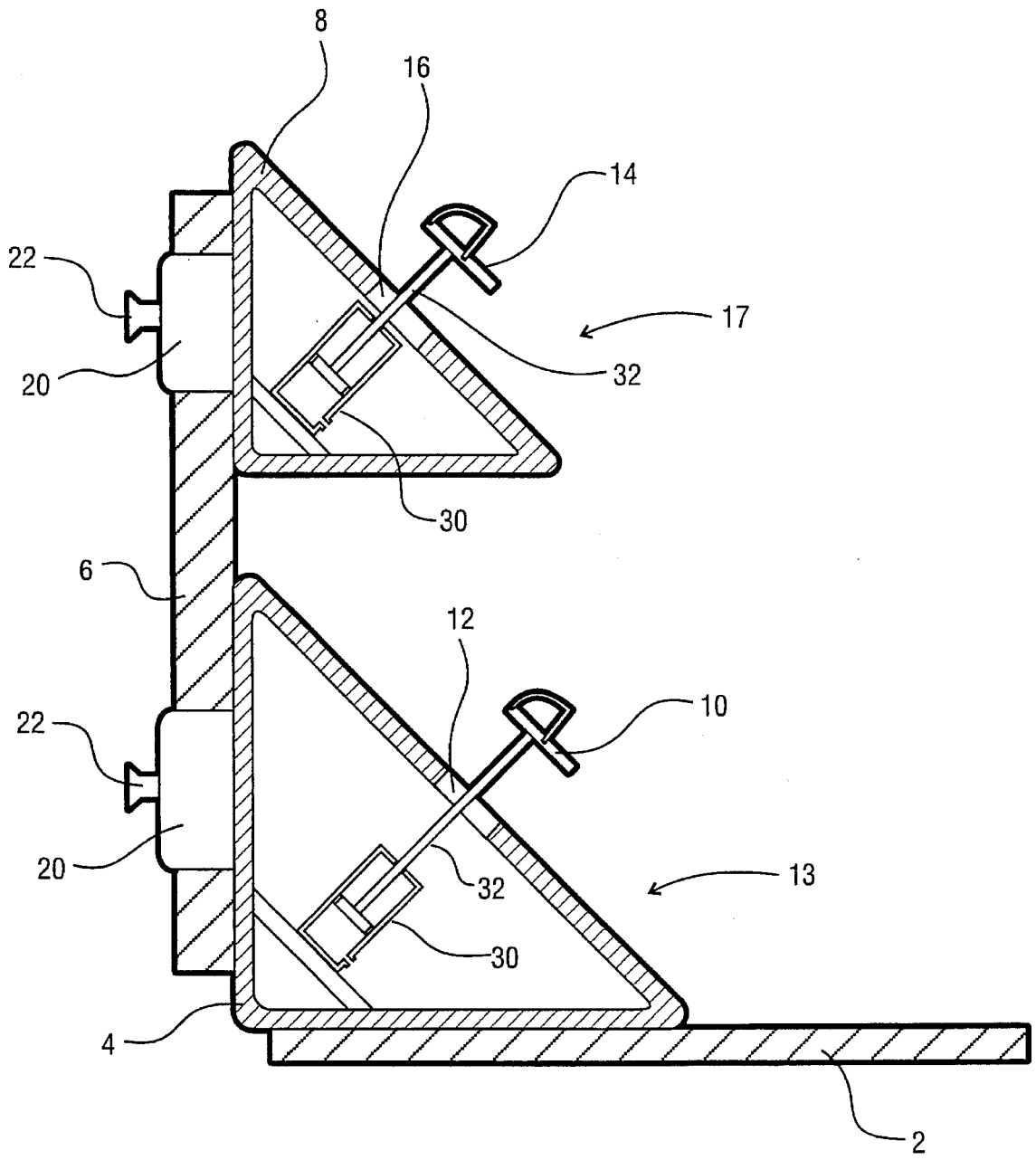
FIG. 2 is a side cross sectional view of the exercise device taken along the lines II—II of FIG. 1.

Referring now to FIG. 2, the attachment of the connecting post 6 to the lower housing 4 and upper housing 8 is shown in detail. The lower housing 4 incorporates a post retaining means 20 which fittingly engages the connecting post 6. A post locking means 22 secures the connecting post 6 within the post retaining means 20. Similarly, the upper housing 8 also incorporates a post retaining means 22 which fittingly engages the connecting post 6. A post locking means 22 secures the post 6 within the post retaining means 20.

Inside the lower housing 4 is contained a pair of air resistance cylinders 30. One air resistance cylinder 30 is in physical communication with each foot pedal 10 via a pedal shaft 32 which passes through the first face 13 of the lower housing 4 through the foot pedal adjustment slot 12.

Similarly, inside the upper housing 8 is contained a pair of air resistance cylinders 30. One air resistance cylinder 30 is in physical communication with each hand pedal via a pedal shaft 32 which passes through the second face 17 of the upper housing 8 through the hand pedal adjustment slot 16. In the preferred embodiment as shown, similar air resistance cylinders 30 are utilized with both an upper housing 8 and a lower housing 4. However, it is currently envisioned that many minor variations could be made within the scope of this disclosure. For example, the upper housing 8 and lower housing 4 could be identical and interchangeable assemblies; or, larger air resistance cylinders 30 could be utilized within the lower housing, just to name two.

Figure 3:
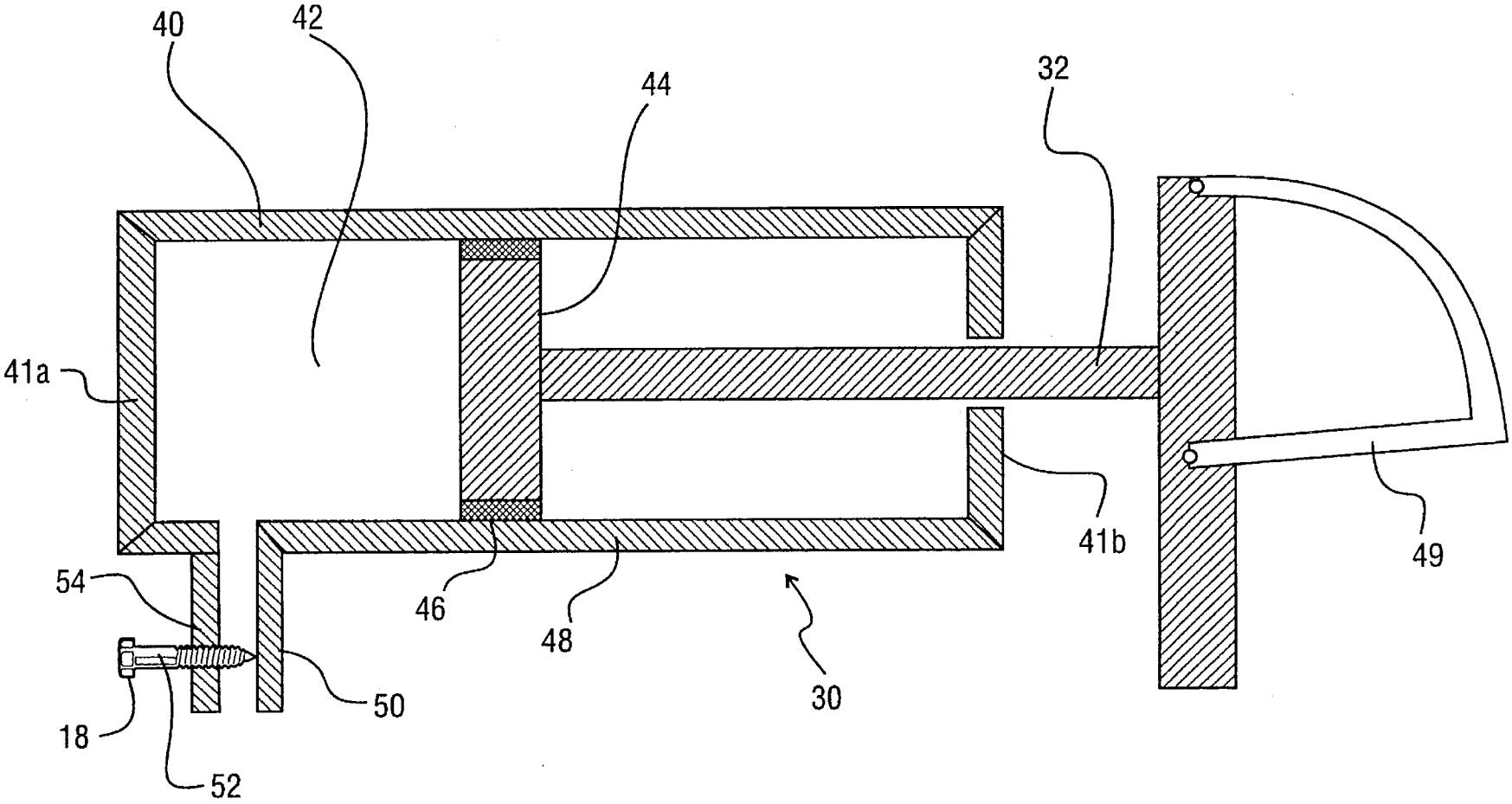
FIG. 3 is a cross sectional side view of a resistance air cylinder 30 for use with an exercise device according to the preferred embodiment of the present invention.

Referring now to FIG. 3, the details of each air resistance cylinder 30 is depicted in detail according to the preferred typical embodiment of the present invention. Each air resistance cylinder 30 is comprised of a tubular, hollow cylinder 40, with a closed end 41A and an open end 41B. The cylinder 40 contains a generally flat piston 44. The inside diameter of the chamber 42 and the outside diameter of the piston 44 are similarly shaped to facilitate the piston 44 sliding fittingly along the length of the chamber 42. A pliable seal 46 is attached along the outer diameter surface 48 of the piston 44, such as to form a generally air-tight chamber 42 while the piston 44 is sliding along the inside of the cylinder 40.

The piston 44 is connected to the pedal shaft 32, which passes out of the open end 41B to attach to the foot pedal 10, or, alternatively and similarly, to the hand pedal 14 (not shown). Affixed to each foot pedal 10 or hand pedal 14 is a grasping means 49, depicted in FIG. 3 as a foot strap attached to and spaced from the foot pedal 10 such that the user can place his or her foot between the grasping means 49 and the foot pedal 10. This allows the user to recover the foot pedal 10 to its original position, while at the same time increasing the exercise benefit by providing a resistance force in both directions. According to the preferred embodiment of the present invention, a similar configuration of grasping means is utilized in conjunction with the hand pedal 14. However, it is also envisioned that alternative methods of grasping the hand pedal may be utilized, such as a rigid, grippable handle.

At the closed end 41A of the cylinder 40 is an exhaust tube 50 in fluid communication through the cylinder 40 with the chamber 42. This exhaust tube 50 allows air to escape from the chamber 42 when the piston 44 is forced into the cylinder 40. A tension adjustment dial 18 (which protrudes through the lower housing 4 and upper housing 8, see FIG. 1) is connected to an exhaust restriction means 52. According to the preferred embodiment as shown in FIG. 3, this exhaust restriction means 52 comprises a threaded insert 54 which can be screwed into the exhaust tube 50 and thereby restrict air flow through the exhaust tube 50. This is the preferred method to adjust the tension provided by the present invention. However, it is envisioned that many readily available methods are currently known to provide similar increases in resistance.

2. Operation of the Preferred Embodiment

Figure 4:
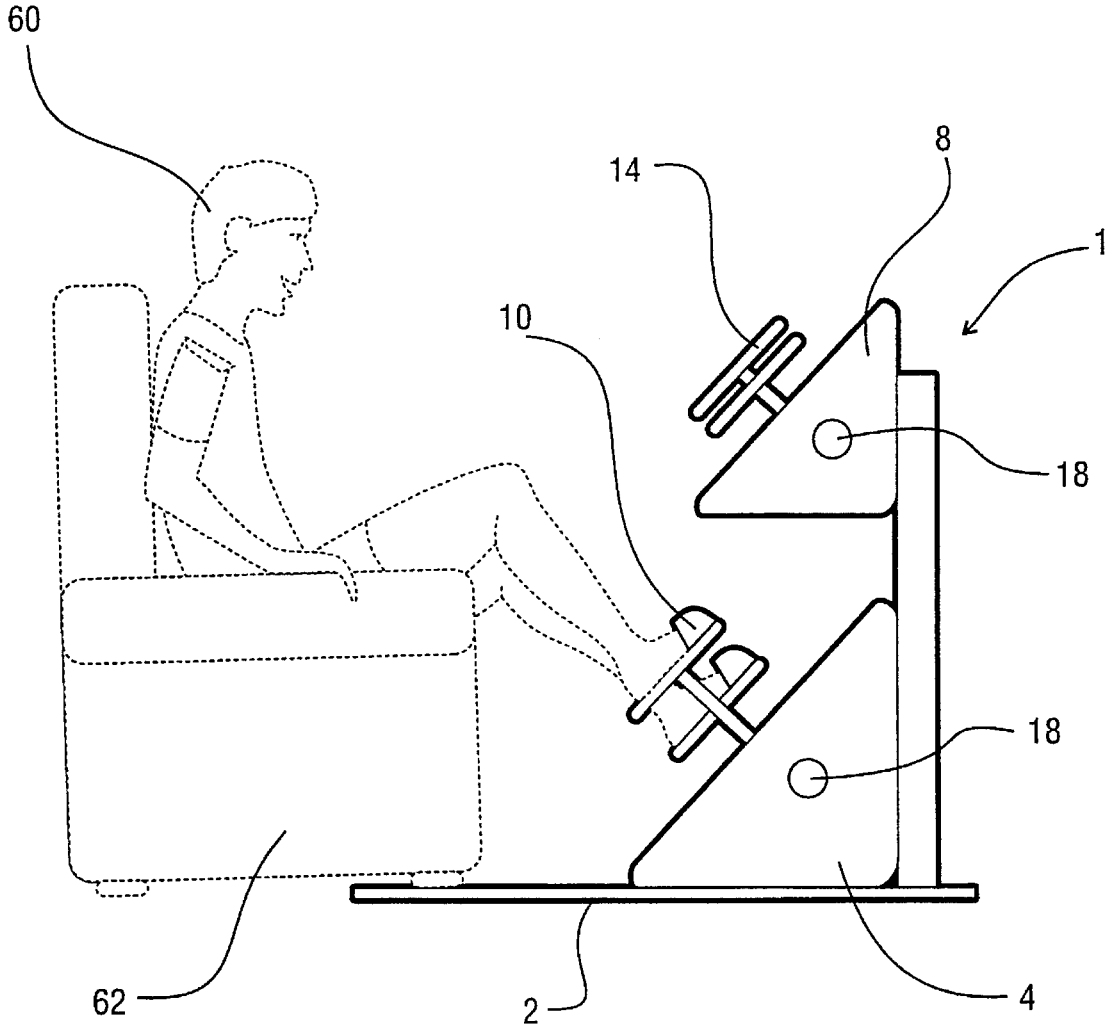
FIG. 4 is a side view of a user exercising with an exercise device according to the preferred embodiment of the present invention.

With reference to FIG. 4, to use the present invention to strengthen and tone upper body muscles, the user 60 first slides the base under a couch 62. Other heavy sitting implements are envisioned as being adequate to employ with the present invention. While sitting on a couch or chair, the user 60 would have the option of using the foot pedals 10 or the arm pedals 14, or a combination thereof. Pressure and resistance to movement is generated as the user 60 depresses the arm pedals 14 or foot pedals 10. The exercise device 1 may then be utilized while watching television, or while engaged in some other form of recreational activity. By entertaining himself or herself while sitting and exercising, the user 60 is more motivated to exercise while taking his or her mind away from the exercise routine.

Auxiliary exercises are afforded by separating the upper housing 8 from the lower housing 4. Now disassembled into two parts, the exercise device 1 may be utilized into floor exercise routines.

The foregoing description is included to illustrate the operation of the preferred embodiment and is not meant to limit the scope of the invention. Those skilled in the art will understand that changes can be made in the preferred embodiments here described, and that these embodiments can be used for other purposes. Such changes and uses are within the scope of the invention, which is limited only by the claims which follow.

What is claimed is:

1. An improved exercise device comprising:

a lower housing, said lower housing comprising a flat front surface, an outer surface, and a generally hollow internal space, and said flat front surface having a slotted penetration allowing continuous physical access to said generally hollow internal space;

an upper housing, said upper housing comprising a flat front surface, an outer surface, and a generally hollow internal space, and said flat front surface having a slotted penetration allowing continuous physical access to said generally hollow internal space;

connection means for detachably connecting said upper housing vertically above said lower housing;

a plurality of foot pedals, each said foot pedal connected to a foot pedal shaft, said foot pedal shaft extending from said lower housing through said slotted penetration;

foot pedal grasping means for removably securing a user's foot to each said foot pedal;

foot pedal resistance means for providing resistance to force applied to said foot pedals, said foot pedal resistance means housed within said lower housing and in connection with said foot pedal shaft;

a plurality of hand pedals, each said hand pedal connected to a hand pedal shaft, said hand pedal shaft extending from said upper housing through said slotted penetration;

hand pedal grasping means for providing a gripping surface to secure a user's hands to each said hand pedal; and hand pedal resistance means for providing resistance to force applied to said hand pedals, said hand pedal resistance means housed within said upper housing and in connection with said hand pedal shaft, whereby said slotted penetrations provide spaced notches for allowing adjustment of the separation between said pedals.

2. The improved exercise device described in claim 1, wherein said lower housing further comprises a laterally elongated base attached to said lower housing to provide a stabilizing base for said exercise device.

3. The improved exercise device described in claim 1, wherein said lower housing comprises a metal triangular shaped box with a flat lower surface and a flat back surface, and wherein said flat front surface is positioned generally at a 45 degree angle to both said flat lower surface and flat back surface.

4. The improved exercise device described in claim 1, wherein said upper housing comprises a metal triangular shaped box with a flat lower surface and a flat back surface, and wherein said flat front surface is positioned generally at a 45 degree angle to both said flat lower surface and flat back surface.

5. The improved exercise device described in claim 1, wherein said connection means for detachably connecting said upper housing vertically above said lower housing comprises:

a post;

lower post retaining means affixed to said lower housing for removably retaining said post to said lower housing;

upper post retaining means affixed to said upper housing for removably retaining said post to said upper housing;

lower post locking means for detachably securing from physical separation said lower post retaining means; and upper post locking means for detachably securing from physical separation said upper post retaining means.

6. The improved exercise device described in claim 1, wherein said foot pedal resistance means for providing resistance to force applied to said foot pedals comprises an air resistance cylinder connected to said foot pedals via said foot petal shaft.

7. The improved exercise device described in claim 1, wherein said foot pedal resistance means for providing resistance to force applied to said foot pedals comprises a plurality of foot pedal resistance means, each said foot pedal resistance means in connection with each said foot pedal, and each said foot pedal resistance means further comprising:

a tubular, hollow cylinder, with a closed end and an open end;

a generally flat piston, the outside diameter of said piston and the inside diameter of said hollow cylinder being similarly shaped to facilitate the piston sliding fittingly along the inside length of the cylinder;

a pliable seal attached along the outer diameter surface of the piston, such as to form a generally air-tight chamber within said cylinder while the piston is sliding along the inside of the cylinder;

air exhaust means for allowing air to escape from said chamber when said piston is forced into the cylinder at the closed end of said cylinder and in fluid communication through said cylinder with said generally air-tight chamber; and resistance adjustment means for adjusting the airflow from the air exhaust means, said tension adjustment means protruding through said lower housing.

8. The improved exercise device described in claim 1, wherein said hand pedal resistance means for providing resistance to force applied to said hand pedals comprises a plurality of hand pedal resistance means, each said hand pedal resistance means in connection with each said hand pedal, and each said hand pedal resistance means further comprising:

a tubular, hollow cylinder, with a closed end and an open end;

a generally flat piston, the outside diameter of said piston and the inside diameter of said hollow cylinder being similarly shaped to facilitate the piston sliding fittingly along the inside length of the cylinder;

a pliable seal attached along the outer diameter surface of the piston, such as to form a generally air-tight chamber within said cylinder while the piston is sliding along the inside of the cylinder;

air exhaust means for allowing air to escape from said chamber when said piston is forced into the cylinder at the closed end of said cylinder and in fluid communication through said cylinder with said generally air-tight chamber; and resistance adjustment means for adjusting the airflow from the air exhaust means, said tension adjustment means protruding through said upper housing.

9. An improved exercise device comprising:

a plurality of aligned housings, each said housing having a plurality of slotted penetrations;

connection means for detachably connecting said housing in an aligned manner;

a plurality of pedals, each said pedal connected to a pedal shaft, said pedal shaft extending from each said housing through said slotted penetration; whereby said slotted penetrations provide spaced notches for allowing adjustment of the separation between said pedals and a plurality of pedal resistance means for providing resistance to force applied to said pedals, said pedal resistance means housed within said housings and in connection with said pedal shafts.

10. The improved exercise device described in claim 9, wherein each aligned housing comprises a flat front surface, an outer surface, and a generally hollow internal space, and said flat front surface containing said slotted penetration allowing continuous physical access to said generally hollow internal space.

11. The improved exercise device described in claim 9, wherein said connection means for detachably connecting said housing in an aligned manner comprises:

a post;

post retaining means affixed to each said housing for removably retaining said post to each said housing; and post locking means for detachably securing from physical separation said post retaining means.

12. The improved exercise device described in claim 9, wherein each said pedal resistance means for providing resistance to force applied to said pedals comprises:

a tubular, hollow cylinder, with a closed end and an open end;

a generally flat piston, the outside diameter of said piston and the inside diameter of said hollow cylinder being similarly shaped to facilitate the piston sliding fittingly along the inside length of the cylinder;

a pliable seal attached along the outer diameter surface of the piston, such as to form a generally air-tight chamber within said cylinder while the piston is sliding along the inside of the cylinder;

air exhaust means for allowing air to escape from said chamber when said piston is forced into the cylinder at the closed end of said cylinder and in fluid communication through said cylinder with said generally air-tight chamber; and resistance adjustment means for adjusting the airflow from the air exhaust means, said tension adjustment means protruding through said lower housing.

* * * * *